US005504666A

United States Patent [19]

Carmichael

[11] Patent Number: 5,504,666

[45] Date of Patent: Apr. 2, 1996

[54] LIGHT BULB COOLING JACKET AND HEAT DISSIPATION SYSTEM

[75] Inventor: Peter Carmichael, Port Coquitlam, Canada

[73] Assignee: 475231 B.C. Ltd., Port Coquitlam, Canada

[21] Appl. No.: 282,739

[22] Filed: Jul. 29, 1994

[51] Int. Cl.[6] ..... F21V 29/00

[52] U.S. Cl. ..... 362/294; 362/96; 362/218; 362/267; 362/373; 313/12; 313/17

[58] Field of Search ..... 362/96, 218, 267, 362/294, 318, 373; 313/12, 17, 22, 24, 35, 36

[56] References Cited

U.S. PATENT DOCUMENTS

| | | | |
|---|---|---|---|
| 1,285,966 | 11/1918 | Farnsworth | 313/12 |
| 1,457,646 | 6/1923 | Wilson | 362/294 |
| 2,352,893 | 7/1944 | Hansell | 313/12 |
| 2,682,006 | 6/1954 | Ferrari, Jr. | 313/12 |
| 3,914,010 | 10/1975 | Zeller | 313/12 |
| 4,363,080 | 12/1982 | Sylvester | 362/96 |
| 4,368,508 | 1/1983 | Gantenbrink | 362/294 |
| 5,147,130 | 9/1992 | Watanuki | 362/218 |

FOREIGN PATENT DOCUMENTS

| | | | |
|---|---|---|---|
| 0113250 | 9/1980 | Japan | 313/36 |
| 0184347 | 9/1966 | U.S.S.R. | 313/12 |
| 0246672 | 6/1969 | U.S.S.R. | 313/36 |

*Primary Examiner*—Ira S. Lazarus
*Assistant Examiner*—Y. Quach
*Attorney, Agent, or Firm*—Oyen Wiggs Green & Mutala

[57] ABSTRACT

A light bulb cooling jacket is adapted to confine a light bulb in a space through which cooling liquid, such as water, may be circulated. The light bulb cooling jacket includes an shell having a rim, the rim defining an opening in the shell. A stopper fits in the opening in the shell and seals against the rim of the shell. The stopper has an aperture in it. The aperture is adapted to receive a portion of a light bulb, which is held and sealed in place in the aperture. The means employed to hold the bulb in place is adapted to engage a generally cylindrical portion of the light bulb, such as the neck of a standard 1000 W bulb. An important characteristic of the present invention that follows from this construction is that the light bulb cooling jacket may be used with a variety of standard high intensity light bulbs. Ports are provided in the stopper for introducing and withdrawing cooling liquid from the space enclosed by the shell and the stopper.

13 Claims, 3 Drawing Sheets

LIGHT BULB COOLING JACKET AND HEAT DISSIPATION SYSTEM

FIELD OF THE INVENTION

The invention is in the field of light bulb heat dissipation devices. More particularly, the invention is in the field of circulating liquid light bulb cooling devices and associated heat dissipation systems.

BACKGROUND OF THE INVENTION

In a variety of enclosed environments, as diverse as greenhouses and operating theatres, there is a need for high intensity lighting. A wide range of light bulbs are available to meet these needs: sodium vapour, metal halide and fluorescent lights are among the choices. In each case however, there is a problem.

High intensity lights invariably produce heat. Sometimes a substantial amount of heat. In an enclosed environment, this heat can build up to unacceptable levels. In greenhouses, as in operating theatres, there are stringent temperature as well as lighting constraints that must be addressed independently. Consequently, expensive air circulation and air conditioning systems are often employed to alleviate the problem caused by the excessive heat produced by high intensity lighting.

In addition to the generalized room heating that high intensity lights produce, they give rise to a second related problem. High intensity lights produce a significant amount of infrared radiation that directly warms all of the surrounding illuminated surfaces. In the greenhouse, this typically means that lights can not be positioned too close to the plants that require illumination. The same principle is of course applicable in an operating theatre.

Finally, apart from the infrared emissions that warm surrounding surfaces, high intensity lights typically become excessively hot themselves. The surface temperature of a high intensity bulb rises very quickly to a level that easily burns living tissue that comes into contact with the bulb. This typically makes it necessary to position high intensity bulbs where they will not come into contact with, for example, people or plants. Of course, this may interfere with optimal lighting.

Previously, water-cooled lighting devices have been addressed to solving specific problems inherent to particularly specialized high intensity light sources. U.S. Pat. No. 5,147,130, issued to Watanuki Sep. 15, 1992 provides an innovative cooling device to deal with the excessive heating of optical filters associated with mercury-vapour lamps. U.S. Pat. No. 4,363,080, issued to Sylvester Dec. 7, 1982 relates to a similarly specialized unit for heat dissipation in conjunction with an optical fibre light source used in dental work. These prior art devices are addressed to particular problems inherent in these specialized light sources, they do not teach a solution to the problems mentioned above.

SUMMARY OF THE INVENTION

It is an object of the present invention to alleviate heat dissipation problems associated with high intensity lighting. In particular, the invention addresses those problems mentioned above that arise most acutely in confined environments where high intensity lighting is employed.

The present invention provides a light bulb cooling jacket that is adapted to confine a light bulb in a space through which cooling liquid, such as water, may be circulated. The light bulb cooling jacket of the invention includes a shell having a rim, the rim defines an opening in the shell. A stopper fits in the opening in the shell and seals against the rim of the shell. The stopper has an aperture in it. The aperture is adapted to receive a portion of a light bulb, which is held and sealed in place in the aperture. The means employed to hold the bulb in place is adapted to engage a generally cylindrical portion of the light bulb, such as the neck of a standard 1000 W bulb. An important characteristic of the present invention that follows from this construction is that the light bulb cooling jacket may be used with a variety of standard high intensity light bulbs. Ports are provided in the stopper for introducing and withdrawing cooling liquid from the space enclosed by the shell and the stopper.

The light bulb cooling jacket of the invention may be sold with packaging material that includes instructions that indicate that the light bulb cooling jacket is adaptable to receive alternative light bulbs, such as a range of standard 1000 W bulbs, which differ in the diameter of the cylindrical portions of the bulbs that are to be held in place in the stopper. The instructions may further indicate that the cooling jacket is adapted for different light bulbs by using alternative parts or mechanisms for sealing the bulbs in the aperture in the stopper. The alternative parts for sealing the bulbs in the aperture may be included in the article of manufacture that is sold with the packaging.

In use, the light bulb cooling jacket of the invention may be part of an integrated heat dissipation system, to move heat away from the light bulbs. Such a system includes cooling liquid, and a heat dissipator, such as a radiator or refrigeration unit, for dissipating heat from the cooling liquid. A pump circulates the cooling liquid. Conduit such piping or flexible hose is used to interconnect the light bulb cooling jacket, heat dissipator and the pump. The cooling liquid employed may be aqueous or non-aqueous, and may include dissolved or suspended components to alter the wavelengths of light emitted by the jacketed bulbs.

If the lighting is in a confined space, such as a greenhouse or operating theatre, the heat dissipation system of the invention may be used to remove heat from the confined space. By adjusting the flow rate of coolant, the heat dissipation system, may in fact be used to remove more heat than is produced by the associated lighting system, providing a net cooling for the confined space.

DETAILED DESCRIPTION OF THE PREFERRED EMBODIMENT

Figures 1, 4:
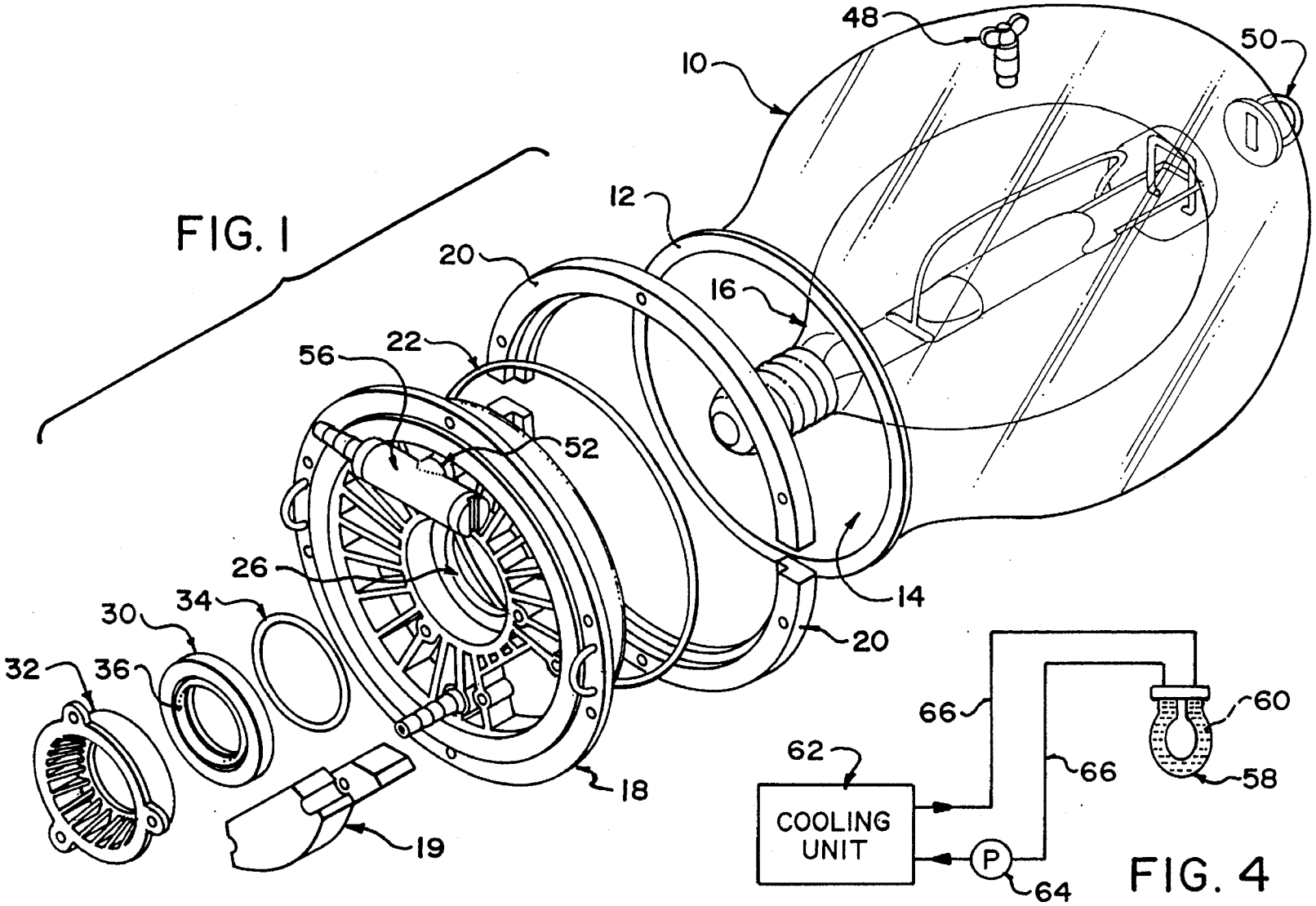
FIG. 1 is an exploded isometric view showing a light bulb cooling jacket according to the invention.
FIG. 4 is a schematic diagram showing a heat dissipation system according to the invention.
Figure 2:
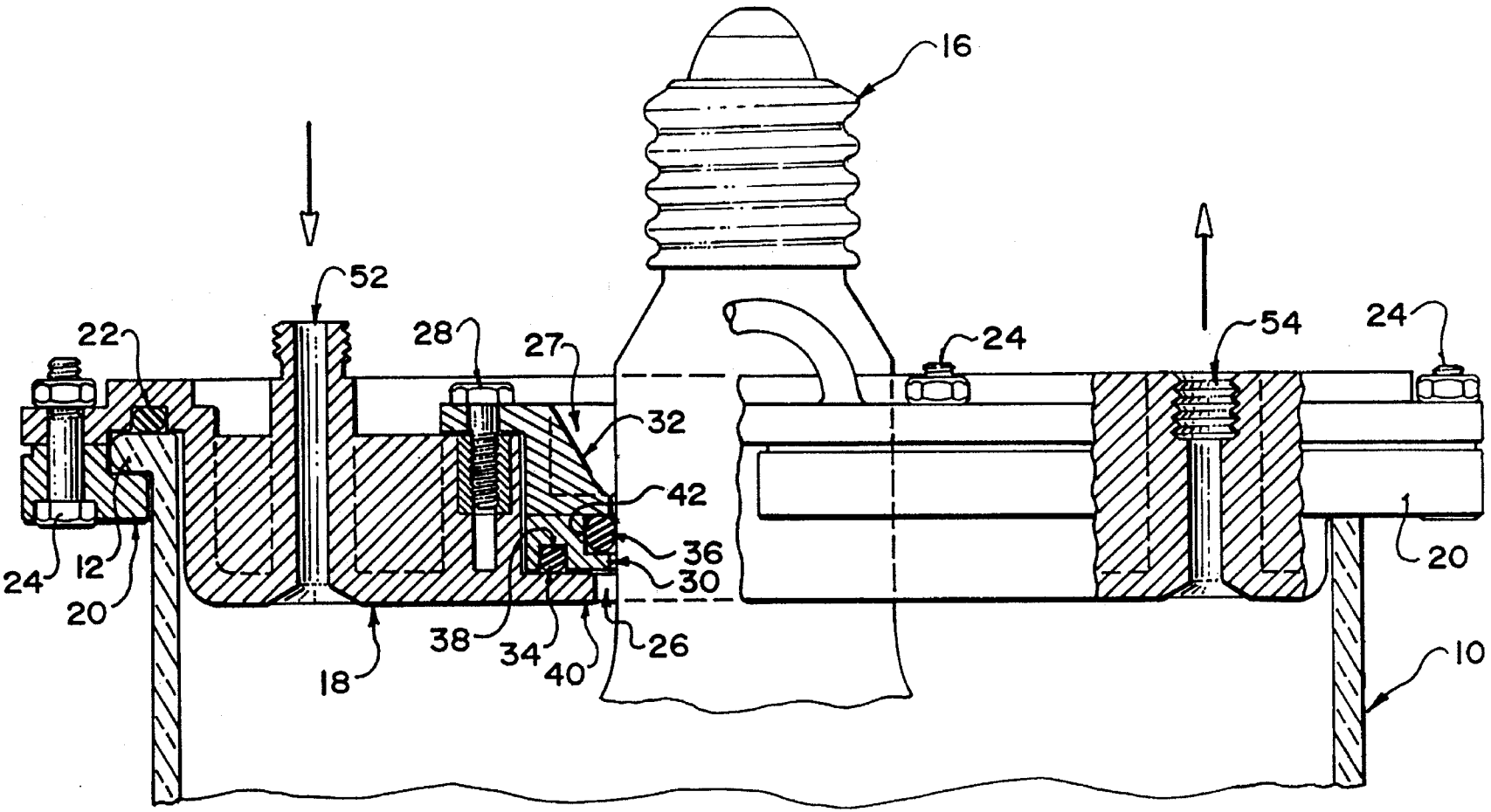
FIG. 2 is an enlarged partially fragmented sectional view showing a portion of a light bulb sleeve assembly cooperating with the aperture defined by the stopper.
Figure 3:
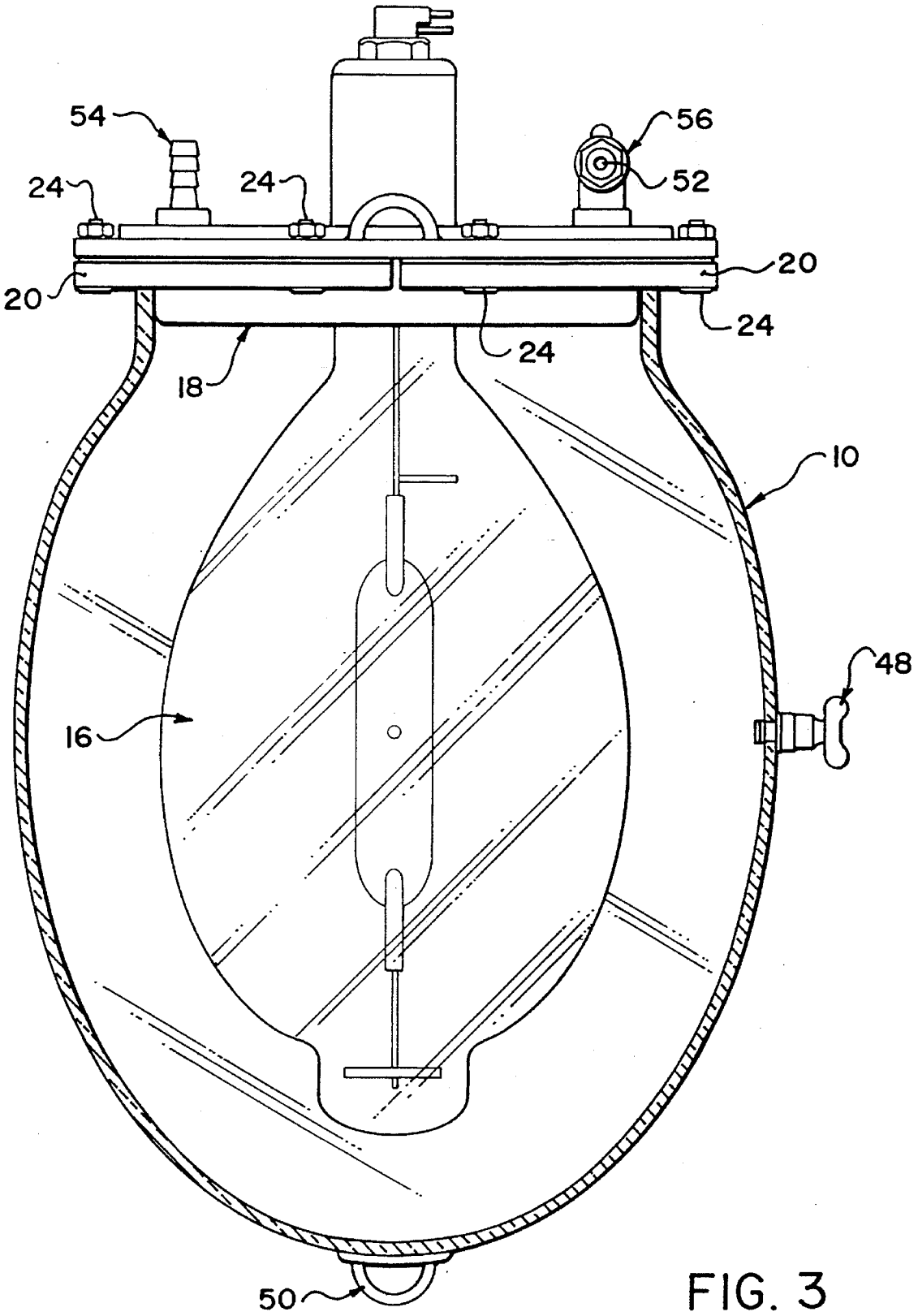
FIG. 3 is a partially sectioned side view showing a light bulb cooling jacket according to the invention, with a light bulb in place in the cooling jacket.

FIGS. 1 and 2 show a preferred bulbous outer shell 10 according to the invention. Shell 10 is adapted to enclose a standard 1000 W light bulb 16 and has a rim 12 which defines an opening 14 larger in diameter than bulb 16. A stopper 18 is sealed to rim 12 by stopper clamps 20, stopper O-ring 22 and bolts 24, as hereinafter explained. A relay 19 may be mounted on the exterior of stopper 18.

Shell 10 has an openable air bleed valve 48 which normally closes an aperture in shell 10. A support hook 50 is mounted on the upper end of shell 10 to facilitate hanging the light bulb cooling jacket assembly from a convenient support.

Stopper 18 defines an aperture 26 through which the stem portion of light bulb 16 passes, as seen in FIG. 2. Brass bolts 28 fasten first and second sealing members 30, 32 to the underside of stopper 18. Sealing members 30, 32 cooperate with first and second O-rings 34, 36 to form a light bulb engaging sleeve assembly 27 within aperture 26.

First sealing member 30 defines a circumferential channel 38 adapted to seat first O-ring 34 for sealing engagement with an adjacent portion 40 of stopper 18.

When juxtaposed, as seen in FIG. 2, first and second sealing members 30, 32 define a circumferential recess 42 adapted to seat second O-ring 36 in cylindrical alignment with aperture 26 for sealing engagement with the stem portion of light bulb 16. Second sealing member 32 is movable by action of brass bolts 28 to compress second O-ring 36 in circumferential recess 42, causing second O-ring 36 to protrude into aperture 26 and into sealing engagement with the stem portion of light bulb 16. A few drops of oil may be used to improve the seal between second O-ring 36 and bulb 16.

The diameter of sleeve assembly 27 may be varied to accommodate and sealably engage light bulbs of varied diameters, thus adapting the invention for use with light bulbs produced by different manufacturers, which tend to be of the same general shape but differ in the diameter of the portion of bulb which passes through aperture 26.

Stopper 18 has inlet and outlet ports 52, 54 through which cooling liquid may enter and leave the space between bulb 16, stopper 18 and shell 10. Ports 52, 54 are barbed to facilitate attachment of a cooling fluid conduit 66, such as flexible hose. Inlet port 52 may have a variable aperture flow valve 56 (FIG. 1).

As shown in FIG. 4, the present invention encompasses a light bulb heat dissipation system including: cooling jacket assembly 58; cooling liquid 60; a heat dissipator ("COOLING UNIT") 62, for dissipating heat from circulating cooling liquid 60; a pump 64, for circulating cooling liquid 60; and, conduit 66, such as flexible hose. Conduit 66 interconnects the parts of the heat dissipation system to carry cooling liquid 60 throughout the heat dissipation system. The cooling liquid 60 should not be introduced into an already hot cooling jacket assembly 58, since thermal shock may adversely affect the cooling jacket assembly.

As will be apparent to those skilled in the art in the light of the foregoing disclosure, many alterations and modifications are possible in the practice of this invention without departing from the spirit or scope thereof. For example, although plain water is a good choice for a cooling medium to reduce infrared emissions from a light source, since water absorbs strongly in the infrared region of the spectrum, other cooling media may be used to act as filters. Solutes that absorb light may, for example, be added to aqueous cooling liquid to alter the spectrum of light emitted by the jacketed bulbs of the invention. Accordingly, the scope of the invention is to be construed in accordance with the substance defined by the following claims.

What is claimed is:

1. A light bulb cooling jacket comprising:

a shell having a rim defining an opening;

a stopper sealably engaging said rim, said stopper defining an aperture adapted to receive a portion of a light bulb;

a first sealing member adjacent to a portion of said stopper;

a first deformable packing disposed between said first sealing member and said adjacent portion of said stopper;

a second sealing member movably attached to said stopper and adjacent to said first sealing member; and, a second deformable packing disposed between said first sealing member and said second sealing member, said second sealing member being movable to compress said second deformable packing against said first sealing member to cause said second deformable packing to protrude into said aperture to sealably engage a stem portion of said light bulb; and, a port in said stopper to allow cooling liquid to circulate through said jacket.

2. The light bulb cooling jacket of claim 1, wherein:

said first sealing member is annular and rigid;

said second sealing member is annular and rigid; said second sealing member is movably and demountably attached to said stopper; and, said first and second deformable packings are O-rings.

3. The light bulb cooling jacket of claim 2, wherein:

said first sealing member defines a circumferential channel adapted to seat said first O-ring, said circumferential channel being adjacent to a portion of said stopper;

said first O-ring is sealably seated in said circumferential channel and sealably abuts said adjacent portion of said stopper;

said first and second sealing members define a circumferential recess adapted to seat said second O-ring, said circumferential recess being adjacent to said aperture in said stopper;

said second O-ring is sealably seated in said second circumferential recess;

said second sealing member is movable to compress said second O-ring in said circumferential recess, such that compression of said second O-ring between said first and second sealing members in said circumferential recess causes said second O-ring to protrude into said aperture.

4. The light bulb cooling jacket of claim 3, wherein said shell further comprises an openable air bleed valve mounted to an aperture in said shell.

5. The light bulb cooling jacket of claim 4, wherein said port further comprises an outlet port and an adjustable inlet port.

6. The light bulb cooling jacket of claim 5, wherein said shell is adapted to surround a said light bulb which is 1000 watt.

7. The light bulb cooling jacket of claim 6, wherein said shell is generally transparent.

8. A light bulb heat dissipation system comprising:

(a) A light bulb cooling jacket comprising:

i) a shell having a rim defining an opening;

ii) a stopper sealably engaging said rim, said stopper defining an aperture adapted to receive a portion of a light bulb;

iii) a first sealing member adjacent to a portion of said stopper;

iv) a first deformable packing disposed between said first sealing member and said adjacent portion of said stopper;

v) a second sealing member movably attached to said stopper and adjacent to said first sealing member;

vi) a second deformable packing disposed between said first sealing member and said second sealing member, said second sealing member being movable to compress said second deformable packing against said first sealing member to cause said second deformable packing to protrude into said aperture to sealably engage a stem portion of said light bulb; and, vii) a port in said stopper to allow cooling liquid to circulate through said jacket;

(b) cooling liquid;

(c) a heat dissipator for dissipating heat from said cooling liquid;

(d) a pump for circulating cooling liquid; and, (e) a conduit interconnecting said light bulb cooling jacket, said heat dissipator and said pump to conduct said cooling liquid to and from said light bulb cooling jacket and said heat dissipator.

9. The light bulb heat dissipation system of claim 8 wherein said cooling liquid is water.

10. The light bulb heat dissipation system of claim 8, wherein said cooling liquid is an aqueous solution comprising a solute that absorbs light.

11. A light bulb heat dissipation system comprising:

(a) A light bulb cooling jacket comprising:

i) a shell having a rim defining an opening;

ii) a stopper sealably engaging said rim, said stopper defining an aperture adapted to receive a portion of a light bulb;

iii) a first annular and rigid sealing member, adjacent to a portion of said stopper defining a circumferential channel adjacent to said portion of said stopper;

iv) a first deformable O-ring packing sealably seated in said circumferential channel and sealably abutting said portion of said stopper;

v) a second annular and rigid sealing member movably and demountably attached to said stopper and adjacent to said first annular and rigid sealing member, said first and second annular and rigid sealing members defining between them a circumferential recess adjacent to said aperture in said stopper;

vi) a second deformable o-ring packing sealably seated in said circumferential recess, said second sealing member being movable to compress said second deformable O-ring packing in said circumferential recess against said first sealing member to cause said second deformable O-ring packing to protrude into said aperture to sealably engage a stem portion of said light bulb; and, vii) a port in said stopper to allow cooling liquid to circulate through said jacket;

(b) cooling liquid;

(c) a heat dissipator for dissipating heat from said cooling liquid;

(d) a pump for circulating cooling liquid; and, (e) a conduit interconnecting said light bulb cooling jacket, said heat dissipator and said pump, to conduct cooling liquid to and from said light bulb cooling jacket and said heat dissipator.

12. The light bulb heat dissipation system of claim 11 wherein said cooling liquid is water.

13. The light bulb heat dissipation system of claim 11, wherein said cooling liquid is an aqueous solution comprising a solute that absorbs light.

* * * * *